United States Patent [19]

Toberg

[11] 4,137,956

[45] Feb. 6, 1979

[54] WOOD INCISOR

[76] Inventor: Lloyd H. Toberg, 11120 SW. Industrial Way, Tualatin, Oreg. 97062

[21] Appl. No.: 810,619

[22] Filed: Jun. 27, 1977

[51] Int. Cl.[2] ..... B27E 9/04

[52] U.S. Cl. ..... 144/2 J; 83/867; 83/678; 144/2 R; 144/116; 144/218; 144/237; 407/31; 407/58

[58] Field of Search ..... 144/3 R, 2 J, 114 R, 144/116, 117 B, 130, 208 R, 208 E, 218, 222, 231, 236, 237, 174; 83/2, 678, 698; 407/56–63, 31, 43

[56] References Cited

U.S. PATENT DOCUMENTS

| | | | |
|---|---|---|---|
| 1,428,308 | 9/1922 | Wiard | 144/237 |
| 1,646,955 | 10/1927 | Edwards et al. | 144/2 J |
| 2,582,658 | 1/1952 | Tackett | 144/116 |
| 3,125,141 | 3/1964 | Best et al. | 144/3 R X |
| 3,478,790 | 11/1969 | Augustin | 144/2 R X |

*Primary Examiner*—Othell M. Simpson
*Assistant Examiner*—W. D. Bray
*Attorney, Agent, or Firm*—Chernoff & Vilhauer

[57] ABSTRACT

A wood incisor for perforating the surfaces of a rectangularly cross-sectioned elongate board preparatory to preservative treatment is comprised of sets of paired horizontal and vertical drums arranged in a manner to provide a rectangular passageway of adjustable height and width for passing various sized boards, with each drum having a plurality of outwardly protruding cutting teeth. Each set of drums includes a fixed drum which is driven, and an idler drum which is slideable with respect to its associated fixed drum by actuation of positioning hydraulic cylinders to provide the adjustability of the passageway therebetween. Each of the positioning hydraulic cylinders is joined end-to-end with a cushioning hydraulic cylinder which is connected hydraulically to an accumulator tank containing pressurized hydraulic fluid and air. Thus the position of each idler drum relative to its associated fixed drum is responsive to the lateral force imparted to that set of drums by the board passing therebetween. Accordingly, when a hard spot is encountered into which the teeth will not penetrate fully, the drums separate slightly preventing damage to their teeth. In addition the vertical set of drums is mounted on a carriage which freely moves side-to-side with respect to the path of the board to accommodate warpage or curvature without binding or attempting to straighten the board. The drums are comprised of a plurality of separate thin annular tooth rings having angularly equi-spaced outwardly protruding teeth. Each tooth ring is interspaced by a selected number of thin annular spacer rings, with all of the tooth rings and spacer rings being clamped together on the core of a drum between removable end plates, and being fixed against rotation on the core by means of a key. Accordingly, the lateral spacing between teeth can be varied to that which is optimum for a selected board by placing the proper number of spacer rings between each tooth ring. Also the tooth rings can easily be replaced individually when a tooth is broken. The tooth rings each have a keyway, for receiving the key located on the core of the drum, which is offset from the centerline of one of the teeth by an angle equal to one-quarter of the angular spacing between adjacent teeth. Therefore by reversing every other tooth ring on the drum, the teeth of adjacent rings are interstitially arrayed.

7 Claims, 12 Drawing Figures

FIG. 1
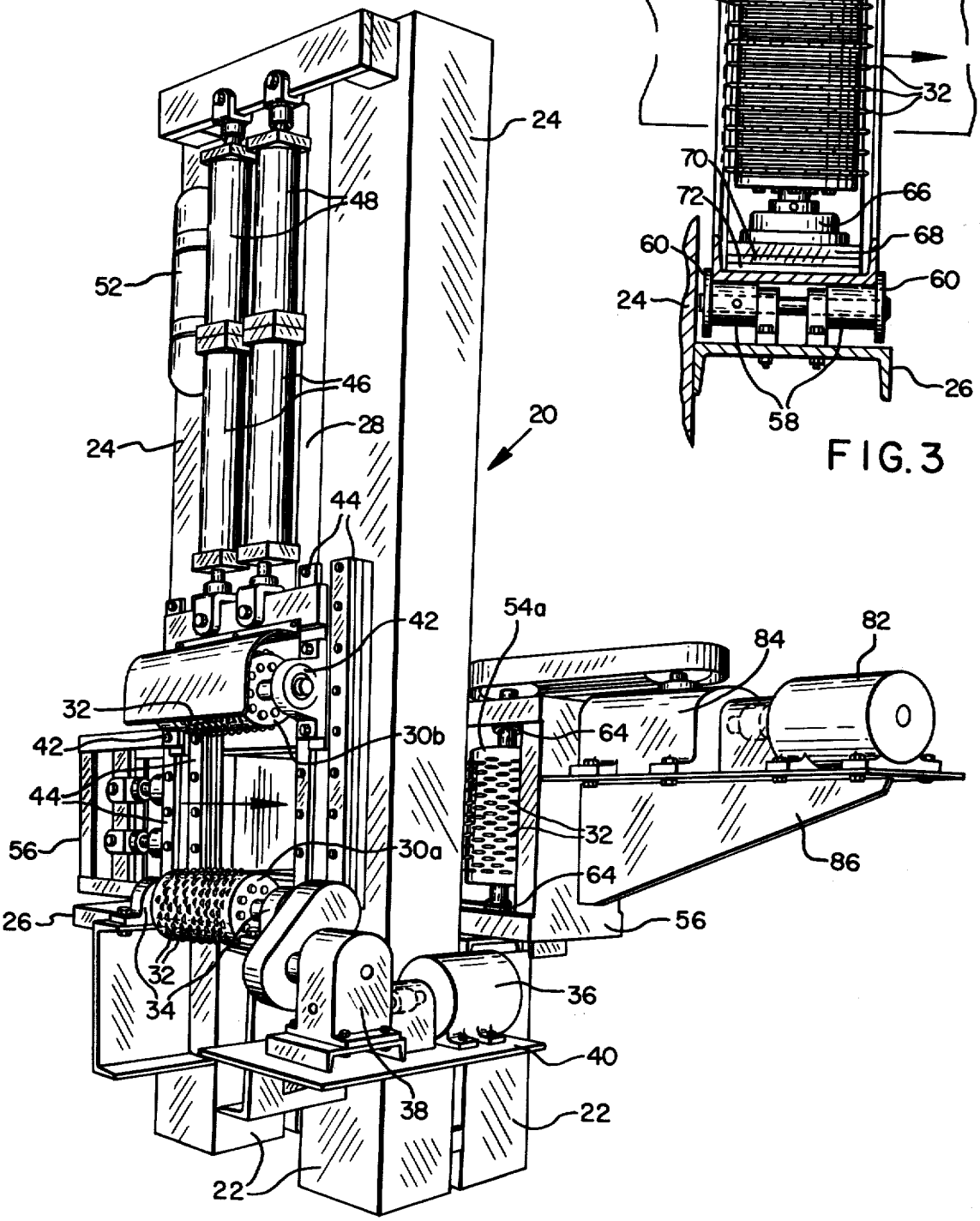
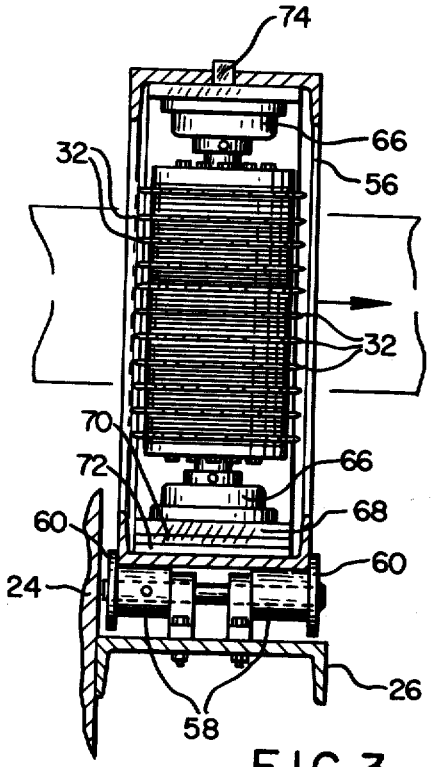
FIG. 3

20
22
24
26
28
30a
30b
32
36
38
40
46
54a
54b
56
58
60
62
64
66
68
70
72
74
76
78
80
82
84
86
3

WOOD INCISOR

BACKGROUND OF THE INVENTION

This invention relates to improvement in rotating drum wood incisors.

When wood boards are preservative treated it is desirable that beforehand perforations be cut at spaced intervals in their surfaces to aid in absorption of the preservative. Wood incisors having driven drums with protruding teeth are generally used for this purpose, with the board being rolled between two perpendicular sets of separated parallel pairs of the drums to form the perforations.

However, boards contain many minor irregularities or hard spots, such as knots, where the teeth will not penetrate to their normal depth. Since the prior art incisors have drums which are separated by a fixed amount, once initially adjusted to accommodate the particular dimensions of the board, problems arise when these irregularities or hard spots are encountered. In many instances the results of this situation is that one or more of the teeth will become broken.

Also it is not uncommon for boards having a small cross-section to become warped or curved. Again the prior art devices of this class are not capable of accommodating this condition and they try to straighten the board as it passes through the drums. As in the former situation, when this condition occurs the drums are subject to damage or tooth breakage.

Finally, the drums of the prior art devices have teeth which are individually installed on the core in a manner such that after extended use the fit of the teeth becomes loose causing breakage or loss of the teeth, and ultimately necessitating expensive replacement of parts. Also, the installation of teeth is a time-consuming operation resulting in considerable down-time of the device. Therefore, the prior art devices are run with broken teeth rather than replacing them as breakage occurs with an attendant loss of performance.

SUMMARY OF THE INVENTION

In order to overcome the aforementioned disadvantages and limitations of the prior art devices of this type, the principal invention provides horizontal and vertical sets of drums, with each drum having outwardly protruding teeth, configured to form a rectangular passageway wherein one of the drums contacts each side of a board traversing the passageway to perforate all of the sides of the board simultaneously. One drum in each set is slideable by means of positioning hydraulic cylinders, which are operable by appropriate controls, in order to adjust the size of the passageway, and the positioning hydraulic cylinders in turn are joined end-to-end to cushioning hydraulic cylinders which are arranged to permit movement of the sliding drum responsive to the separating force imparted to the respective sets of drums by the board. The cushioning hydraulic cylinders are connected hydraulically to an accumulator tank containing pressurized air and hydraulic fluid so that when the drums encounter minor irregularities or hard spots in the board which prevent the proper penetration of the teeth, the drums are separated slightly thereby protecting the teeth against breakage.

The vertical set of drums is mounted on a carriage which slides freely laterally with respect to the horizontal set of drums to accommodate boards which are warped or bent. Accordingly, since boards are normally bent only in one plane they can be oriented before placement in the device so that they can be perforated in their bent condition without binding or overloading the device.

The drums utilized in the present invention comprise cylindrical cores which mount a plurality of thin annular tooth rings each having outwardly protruding sharpened knife blades located at equal angles around its periphery. Accordingly a single tooth ring can be easily replaced when a tooth is broken. The tooth rings are separated by a selected number of thin annular spacer rings, with the number of such rings positioned between each tooth ring being variable to tailor the lateral tooth spacing to that optimum for a given sized board. The tooth rings and spacer rings are fixed to the core of the drum by means of a key, and are clamped together between end plates which are releasably joined to the core.

Each tooth ring has a keyway located in its inner surface which is offset from the centerline of one of the teeth by an angle equal to one-quarter of the angle between adjacent teeth. Therefore, by reversing every other tooth ring on the drum, the teeth in alternate rows can be arranged interstitially without the necessity of providing two different configurations of tooth rings.

The foregoing objectives, features and advantages of the present invention will be more readily understood upon consideration of the following detailed description of the invention taken in conjunction with the accompanying drawings.

BRIEF DESCRIPTION OF THE DRAWINGS

FIG. 1 is a perspective view showing a preferred embodiment of the wood incisor of the present invention, looking from the front.

FIG. 3 is a sectional view taken on the line 3—3 of FIG. 2.

DETAILED DESCRIPTION OF THE INVENTION

Figures 2, 4:
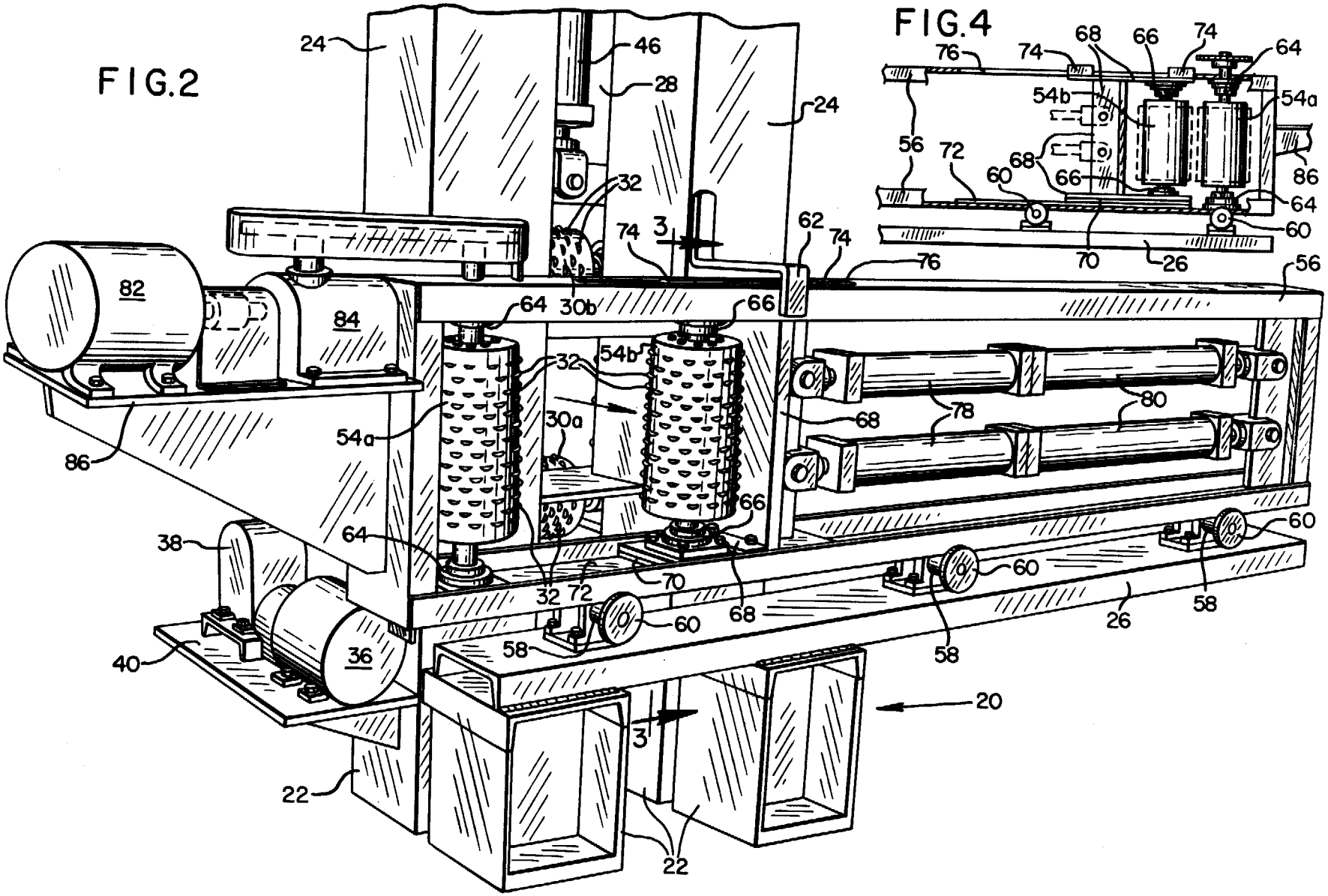
FIG. 2 is a fragmentary perspective view of the wood incisor of FIG. 1 looking from the rear.
FIG. 4 is a fragmentary elevation view, partially broken away, taken generally normal to FIG. 3.

Referring to FIGS. 1 and 2 of the drawings, the wood incisor of the present invention includes a mounting platform 20 which mounts the operative elements of the device. The mounting platform generally comprises four box-shaped legs 22 which support paired rectangular cross-sectioned upright masts 24 and an elongate horizontal platform 26. The masts are separated to provide a gap 28 therebetween sufficient to pass the largest board intended to be processed on the device, and platform 26 is located adjacent to one side of the masts across gap 28 and is oriented off-center of the masts so that it extends beyond them by a greater amount on one side than on the other.

Located adjacent to the masts, spanning gap 28, are paired generally horizontal first drums 30, each having a plurality of outwardly protruding knife blades 32. The lower first drum 30*a* is rotatably mounted on bearing blocks 34, which are attached to the mounting platform, and is driven by a motor 36 through a reduction unit 38. The motor and reduction unit are attached to the mounting platform by means of a shelf 40.

The upper first drum 30*b* is freely rotatably mounted on bearing blocks 42 which are similar to bearing blocks 34 but which are freely slideable vertically in tracks 44 attached to masts 24. Thus the axes of rotation of the two first drums are parallel and coplanar and are separated from one another horizontally by a variable distance.

Figure 12:
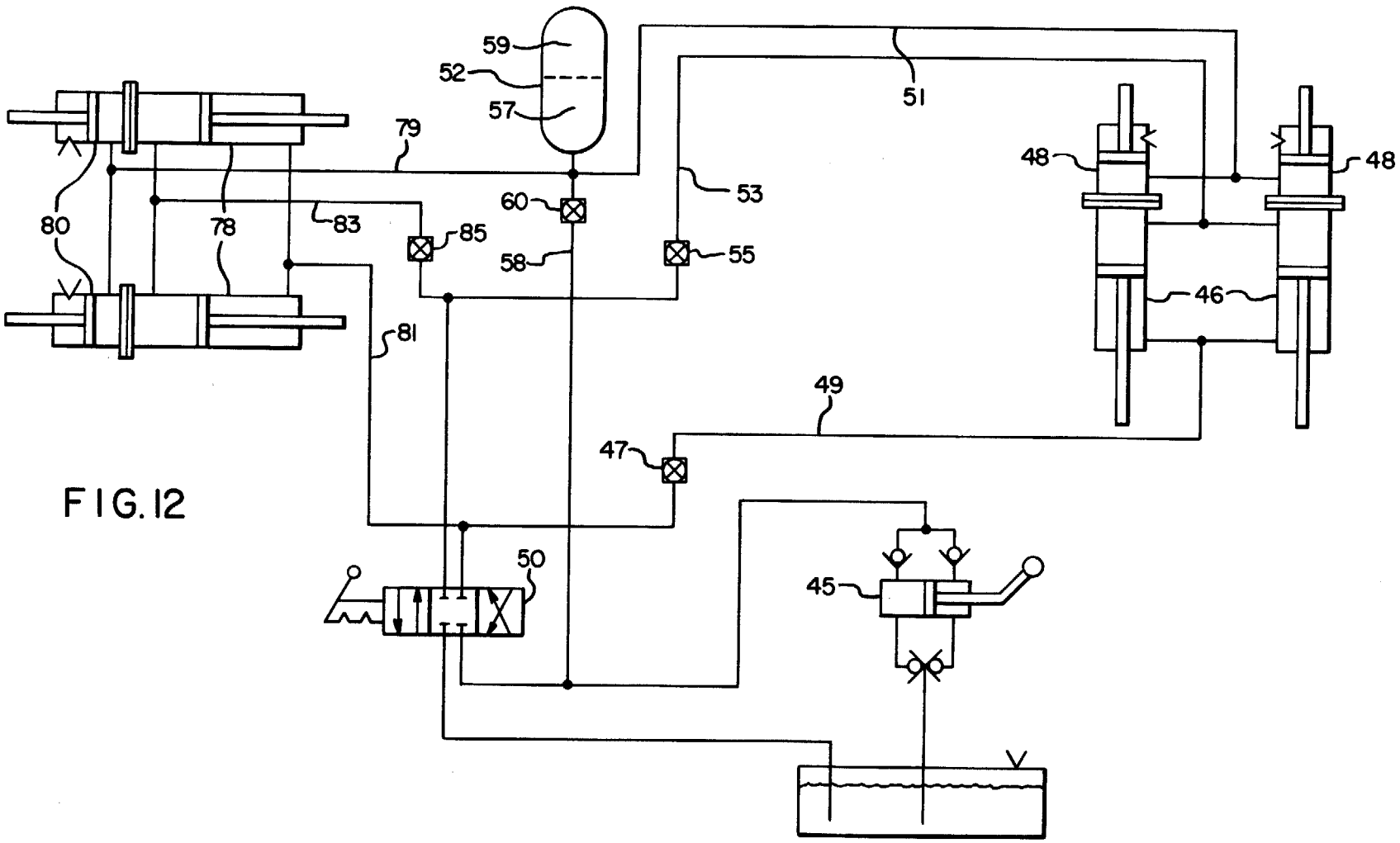
FIG. 12 is a schematic view showing the hydraulic circuitry used in the operation of the present invention.

The upper first drum is translatable in tracks 44 by means of double-acting fluid operated cylinders, such as parallel paired hydraulic positioning cylinders 46. Referring to FIG. 12, positioning cylinders 46 are actuated by fluid from a hand operated pump 45 through a positioning valve 50 to control the amount of separation between drums 30*a* and 30*b*. When positioning valve 50 is in its straight through position, the fluid passes to positioning cylinders 46 through line 49 to raise drum 30*b*. A valve 47 is located in line 49 to prevent inadvertent lowering of the drum by gravity due to leakage. When the positioning valve is in its crossed position the fluid passes to positioning cylinders 46 through line 53 to lower drum 30*b*. A valve 55 is located in line 53 to allow isolating positioning cylinders 46 from the influence of pump 45.

The positioning cylinders are not attached directly to the mounting platform but each is interconnected thereto through a hydraulic cushioning cylinder 48. Cushioning cylinders 48 are hydraulically connected, at their ends which are adjacent to the positioning cylinders, by means of line 51 to an accumulator tank 52. Tank 52 contains both air 59 and hydraulic fluid 57 which is pressurized by pump 45 through line 58 and trapped by the closing of a valve 60. Thus cushioning cylinders 48 are partially extended but retract automatically responsive to increased loading between the first drums due to the compressibility of the air 59 contained in accumulator 52. Accordingly when irregularities or hard portions in the board being processed pass between the drums they are automatically accommodated, thereby preventing excessive wear or breakage of teeth 32.

Paired generally vertical second drums 54, similar to first drums 30, are located adjacent to masts 24 opposite the first drums. They are rotatable on axes which are parallel and coplanar to each other and lie on a plane which is parallel with the plane of the axes about which drums 30 rotate. However, the axes of drums 54 are oriented vertically rather than horizontally thereby forming a rectangular passageway with one drum bounding each side thereof. The second drums are mounted on a rectangular carriage 56 which is movable laterally with respect to the longitudinal axis of the board above platform 26 on rollers 58. Discs 60, which are attached to the ends of rollers 58, act in conjunction with a guide 62, which is attached to mounting platform 20, to retain carriage 56 against lateral and vertical movement while allowing its free longitudinal translation. Therefore, the second drums are free to shift in unison in response to curvature and irregularities in the board being processed.

The second drums includes a fixed driven drum 54*a*, FIG. 3, which is rotatably attached to carriage 56 by means of bearings 64, and a slideable idler drum 54*b* which is rotatably mounted in bearings 66. Bearings 66 are mounted to a sled 68, FIG. 4, which is slideably carried in carriage 56, thereby permitting the gap between the drums to be varied to accommodate boards having different widths. The bottom of sled 68 fits snugly within the bottom element of carriage 56, and has a low friction liner 70 attached to its lower surface which slides on a like configured liner 72 which is attached to the bottom element of carriage 56. Tabs 74 extend upwardly from the top of sled 68 through a slot 76 which is located in the top element of carriage 56 to restrain the sled against lateral movement.

Parallel paired double-acting hydraulic positioning cylinders 78 are used to position sled 68, and thus idler drum 54*b*, with respect to the fixed drum 54*a*. Positioning cylinders 78 are also operated by pump 45 through positioning valve 50. When the positioning valve is in its straight through position, fluid is passed to positioning cylinders 78 through line 81 to move drum 54*b* away from drum 54*a*. When the positioning valve is in its crossed position fluid is passed to positioning cylinders 78 through line 83 to move drum 54*b* toward drum 54*a*. A valve 85 is located in line 83 to allow isolating positioning cylinders 78 from the influence of pump 45.

Each of the positioning cylinders is interconnected to the carriage by means of a hydraulic cushioning cylinder 80 which is hydraulically connected to accummulator tank 52 by means of line 79 in a manner similar to that of cushioning hydraulic cylinders 48. Accordingly cushioning cylinders 80 operate in the same manner as cushioning cylinders 48, and are responsive to pressure on the drums to accommodate irregularities or hard portions in the board.

Driven drum 54*a* is driven by a motor 82 through a gear reduction unit 84, both of which are mounted to the carriage by means of a platform 86. Since platform 86 is attached to the carriage, the motor and fixed drum move together upon translation of the carriage.

Figure 5:
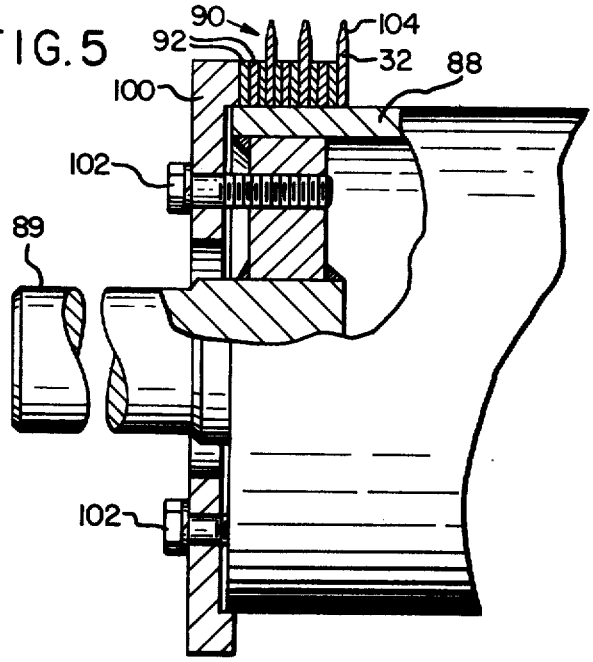
FIG. 5 is a fragmentary side elevation view, partially broken away, showing one of the drums which are elements of the present invention.
Figure 6:
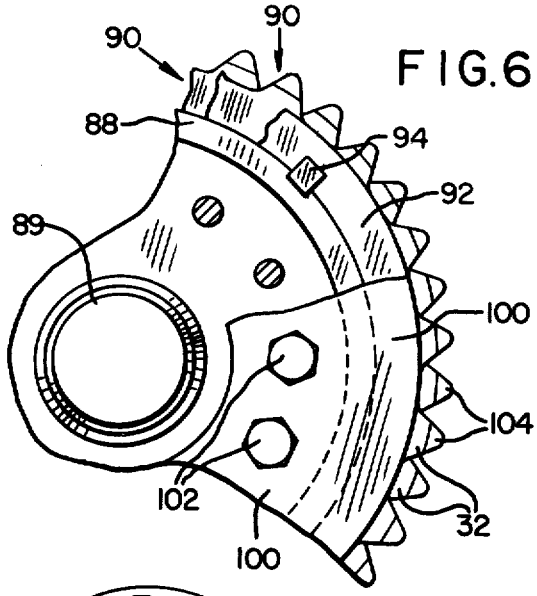
FIG. 6 is a fragmentary end elevation view, partially broken away, of the drum of FIG. 5.
Figure 9:
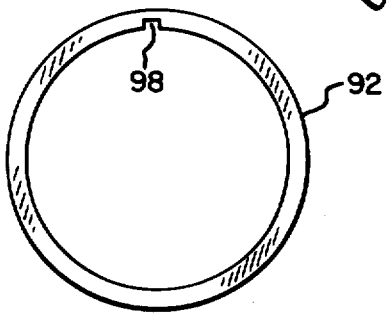
FIG. 9 is a detailed view of a spacer ring used on the drum.
Figure 11:
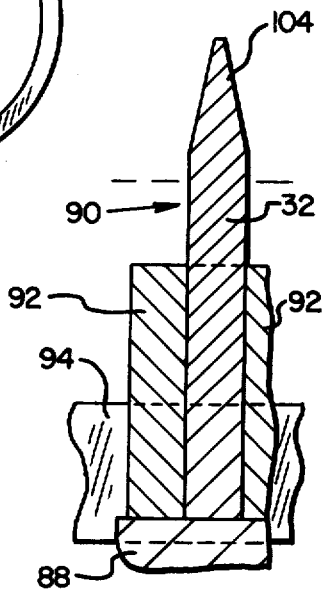
FIG. 11 is a fragmentary, sectional, detailed view showing the relationship of the tooth ring and the spacer ring on the drum.

Referring to FIGS. 5 and 6, drums 30 and 54 each are comprised of a cylindrical core 88, having medial shafts 89 extending from each end, which carries a plurality of individual annular tooth rings 90, each separated by one or more annular spacers 92, FIG. 9. The tooth rings and spacers fit snugly over the core and are fixed thereto by means of a key 94, FIG. 11, which engages keyways 96 and 98 located respectively in the tooth rings and spacers. The tooth rings and the spacers are clamped together by means of end plates 100 which are attached to core 88 by means of bolts 102. Accordingly when teeth become broken in use, only the tooth rings associated with the broken teeth need to be replaced rather than having to replace an entire drum.

Figure 10:
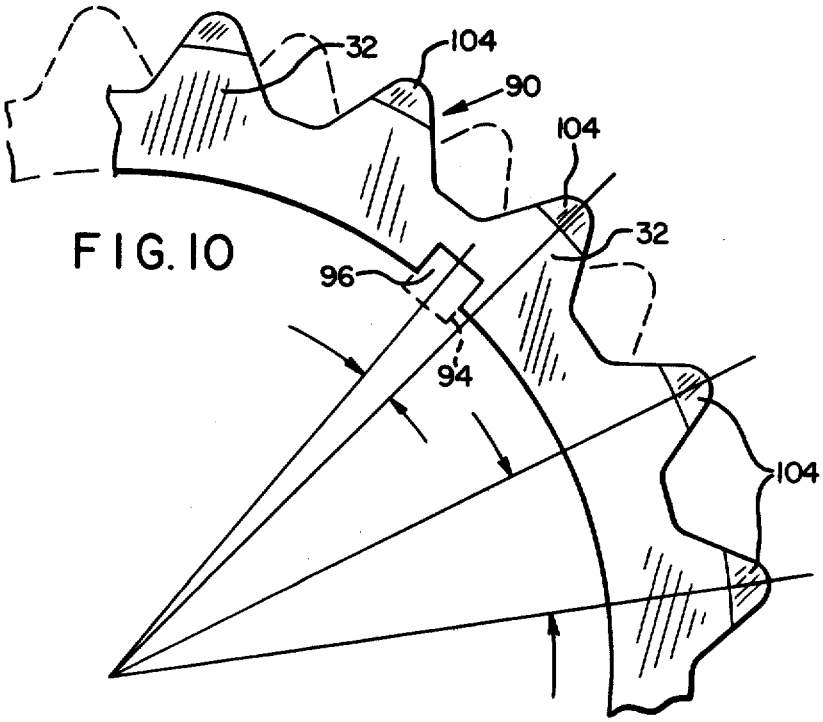
FIG. 10 is a fragmentary detailed view of a tooth ring used on the drum.

Each tooth ring, best shown in FIG. 10, comprises a thin annular element having outwardly extending angularly equi-spaced teeth 32 located about its periphery. The extremities of the teeth are beveled inwardly to form sharp tips 104. Keyway 96 is located in the inner surface of the tooth ring at a position which is radially offset from the centerline of one of the teeth by an angle equal to one-quarter of the angle between adjacent teeth. Therefore by reversing every other tooth ring, every other row of teeth is offset from its adjacent row by one-half of a tooth spacing, thereby causing the teeth to be interstitially arrayed, FIGS. 6 and 10. Accordingly only one tooth ring configuration is required for a variety of angular teeth position patterns.

Figure 8:
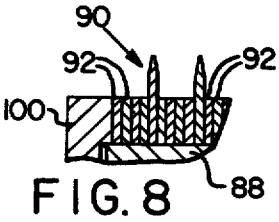
FIGS. 7 and 8 are detailed sectional views showing the arrangement of teeth on the drum.
Figure 7:
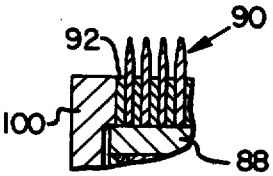

As will be noted from FIGS. 5, 7 and 8, the spacing of adjacent tooth rings can be varied by the number of spacers placed between them. Thus the spacing between perforations in the board can be adjusted to that spacing which is optimum for a given board dimension.

To operate the device, accumulator 52 is first pressurized by opening valve 60 and operating pump 45 with positioning valve 50 in its neutral position. When sufficient pressure is achieved, valve 60 is closed thereby trapping the pressurized fluid. While in the embodiment illustrated, the pressure in the accumulator is set by the time of pump operation, means can be provided if desired to allow adjustability of accumulator pressure. It may be necessary to open valve 60 from time-to-time when the device is operating to re-pressurize the accumulator due to leakage of hydraulic fluid.

A board of the size to be perforated is then placed adjacent to the passageway defined by drums 30 and 54 for adjustment of idler drums 30*b* and 54*b* respectively. By placing positioning valve 50 in its crossed position and operating pump 45 with valves 47 and 55 closed and valve 85 open, positioning cylinders 78 are extended to move drum 54*b* toward drum 54*a*. Once the spacing of drum 54*b* is adjusted to give the desired penetration of teeth 32 into the sides of the board, valve 85 is closed.

Valves 47 and 55 then are opened causing positioning cylinders 46 to be extended to move drum 30*b* toward drum 30*a*. Once the spacing of drums 54 is adjusted to give the desired tooth penetration, valves 47 and 45 are closed and the device is ready for use.

In setting the spacing between both sets of drums, final adjustment is made by operating the positioning valve between its crossed and straight through positions to move the associated drums respectively closer together or farther apart until the desired separation is achieved.

Once the drums are adjusted, motors 40 and 82 are operated, and boards are fed through the passageway to be perforated by the drums. It will be appreciated that any small irregularities or hard spots in the boards which will resist penetration of teeth 32 will cause movement of the idler drum affected away from its associated fixed drum due to the effect of accumulator 52 acting against the cushioning cylinders associated with that drum. It will be noted that by increasing or decreasing pressure on the accumulator a wide variety of wood density can be accommodated, such as pine, fir, hemlock, or other woods. Thus by using the proper accumulator pressure setting even hard spots in soft wood can be cushioned. Also any large irregularities or curvature in the board is accommodated by the free lateral translation of drums 54 simultaneously with carriage 56. Since boards generally are only bent in their smaller dimension they can be placed in the device such that the bend is coplanar with the sides of the board contacted by drums 54.

The terms and expressions which have been employed in the foregoing abstract and specificaiton are used herein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A wood incisor for forming a plurality of spaced perforations in the faces of rectangularly cross-sectioned boards preparatory to the preservative treatment of the boards comprising:
   (a) a mounting platform;
   (b) paired first drums rotatably journaled on said mounting platform on mutually parallel first axes which are laterally separated from each other;
   (c) paired second drums rotatably journaled on said mounting platform on mutually parallel second axes which are laterally separated from each other and extend perpendicularly to said first axes;
   (d) said first pair of drums and said second pair of drums being located such that an elongate board can be moved longitudinally between said first pair of drums and said second pair of drums;
   (e) said drums having a plurality of outwardly protruding teeth;
   (f) said first and said second pairs of drums each including a driven drum and an idler drum, one of said drums in each pair being translatable toward or away from the respective other drum in said pair for adjustment of the lateral separation therebetween;
   (g) means for rotatably driving said driven drums; and
   (h) carriage means for mounting at least one of said pair of drums and its associated driving means; said carriage means being freely slidably mounted on said mounting platform for lateral movement perpendicularly to the axis of said one pair of drums for permitting movement of said one pair of drums laterally in unison such that the individual drums of said one pair of drums maintain a predetermined separation with respect to each other despite the movement of said carriage means.

2. The wood incisor of claim 1 wherein said first drums are mounted with their axes substantially horizontal and the second drums are mounted with their axes substantially vertical, and said second pair of drums is the one mounted on said carriage.

3. The wood incisor of claim 2 wherein the carriage means comprises a rectangular frame and the invention further includes:
   (a) sets of spaced apart rollers, mounted on said mounting platform, said rollers being configured for rotatably carrying said frame longitudinally and for preventing lateral displacement thereof; and
   (b) a guide mounted on said mounting platform opposite said rollers in a manner to guide the frame.

4. A tooth ring for use in rotary perforating drums of wood incisors comprising:
   (a) a thin annular element having a circular inner surface and having angularly equi-spaced outwardly protruding teeth located about its periphery;
   (b) said inner surface defining a keyway for fixing said tooth ring to said drum; and
   (c) said keyway being positioned radially offset from the centerline of one of said teeth by an angle which is equal to one-quarter of the angle between adjacent teeth on said ring so that by reversing every other tooth ring when a plurality of tooth rings are mounted side-by-side on said drum, the teeth on adjacent rings are interstitially arrayed.

5. A wood incisor for forming a plurality of spaced perforations in the faces of rectangularly cross-sectioned boards preparatory to the preservative treatment of the boards comprising:

(a) a mounting platform;

(b) paired first drums rotatably journaled on said mounting platform on mutually parallel first axes which are laterally separated from each other;

(c) paired second drums rotatably journaled on said mounting platform on mutually parallel second axes which are laterally separated from each other and extend perpendicularly to said first axes;

(d) said first pair of drums and said second pair of drums being located such that an elongate board can be moved longitudinally between said first pair of drums and said second pair of drums;

(e) said first and second pairs of drums each including a driven drum and an idler drum, one of said drums in each pair being translatable toward or away from the respective other drum in said pair for adjustment of the lateral separation therebetween;

(f) means for rotatably driving said driven drums; and (g) said drums including a plurality of separate thin annular tooth rings having radially outwardly protruding teeth, interspaced along the axis of the drum by a selective number of annular spacer rings, all fixedly joined in adjacency on a cylindrical core, wherein the teeth are angularly equi-spaced on said tooth rings and said tooth rings and said idler rings are fixed to said core by means of a key and each tooth ring has defined therein a keyway which is radially offset from the center of one of said teeth by an angle which is one-quarter of the angle between adjacent teeth on said ring, so that by reversing every other tooth ring the teeth on adjacent tooth rings are interstitially arrayed.

6. A wood incisor for forming a plurality of spaced perforations in the faces of rectangularly cross-sectioned beams preparatory to the preservative treatment of the beam comprising:

(a) a mounting platform;

(b) paired first drums rotatably journaled on said mounting platform on mutually parallel first axes which are laterally separated from each other;

(c) paired second drums rotatably journaled on said mounting platform on mutually parallel second axes which are laterally separated from each other and extend perpendicularly to said first axes;

(d) said first pair of drums and said second pair of drums being located such that an elongate board can be translated respectively between said first pair of drums and said second pair of drums;

(e) said drums having a plurality of outwardly protruding teeth;

(f) said first and second pairs of drums each including a driven drum and an idler drum, one of said drums in each pair being translatable toward or away from the respective other drum in said pair for adjustment of the lateral separation therebetween;

(g) means for rotatably driving said driven drums;

(h) translating means for selectively moving the translating drum in each pair toward or away from the respective other drum in said pair, said translating means including double-acting fluid-operated positioning cylinders; and (i) yieldable means, associated with said translating means for providing minor variation in the separation of the drums in each pair with respect to each other responsive to the force created therebetween by the board, said yieldable means comprising;

(1) a fluid operated cushioning cylinder associated with each of said positioning cylinders and interconnecting said positioning cylinder to the mounting platform, (2) an accumulator tank operatively interconnected to one end of each of said cushioning cylinders in a manner to cause extension of said cushioning cylinders upon application of pressure to said accumulator tank, (3) said accumulator tank being at least partially filled with a compressable gas; and (4) means for pressurizing the fluid and gas in said accumulator tank to a predetermined level.

7. The wood incisor of claim 6 including means for adjusting the pressure in said accumulator tank.

* * * * *